US006652400B2

(12) United States Patent
Duesmann et al.

(10) Patent No.: US 6,652,400 B2
(45) Date of Patent: Nov. 25, 2003

(54) CHAIN DRIVE FOR DRIVING TWO PARALLEL SHAFTS LOCATED CLOSE TO EACH OTHER

(75) Inventors: Markus Duesmann, Stolberg (DE); Lukas Wagener, Kohlscheid (DE); Rainer Lach, Würselen (DE); Jürgen Buck, Wald (CH)

(73) Assignee: FEV Motorentechnik GmbH, Aachen (DE)

( * ) Notice: Subject to any disclaimer, the term of this patent is extended or adjusted under 35 U.S.C. 154(b) by 71 days.

(21) Appl. No.: 09/914,764

(22) PCT Filed: Dec. 13, 2000

(86) PCT No.: PCT/EP00/12634

§ 371 (c)(1),
(2), (4) Date: Nov. 9, 2001

(87) PCT Pub. No.: WO01/49977

PCT Pub. Date: Jul. 12, 2001

(65) Prior Publication Data

US 2002/0134336 A1 Sep. 26, 2002

(30) Foreign Application Priority Data

| | | |
|---|---|---|
| Jan. 5, 2000 | (DE) | 100 00 197 |
| May 12, 2000 | (DE) | 100 23 209 |
| Aug. 26, 2000 | (DE) | 100 42 041 |

(51) Int. Cl.[7] ..... F16H 7/18

(52) U.S. Cl. ..... 474/86; 474/84; 474/148

(58) Field of Search ..... 474/84, 85, 140, 474/141, 144, 152, 156, 148, 900, 86

(56) References Cited

U.S. PATENT DOCUMENTS

| | | | | |
|---|---|---|---|---|
| 4,348,199 A | * | 9/1982 | Oonuma et al. | 474/156 |
| 5,178,108 A | * | 1/1993 | Beaber | 123/90.31 |
| 5,846,149 A | * | 12/1998 | Ledvina et al. | 474/84 |

FOREIGN PATENT DOCUMENTS

| | | |
|---|---|---|
| DE | 33 47 638 | 7/1985 |
| EP | 0 575 044 | 12/1993 |
| JP | 57210109 | 12/1982 |
| JP | 60091054 | 5/1985 |

* cited by examiner

*Primary Examiner*—Thomas R. Hannon
*Assistant Examiner*—Vicky A. Johnson
(74) *Attorney, Agent, or Firm*—Venable LLP; Norman N. Kunitz

(57) ABSTRACT

A chain drive for driving two adjacent parallel shafts, such as two overhead camshafts in an internal combustion engine, includes a drive chain guided by a drive mechanism and chain wheels mounted on the shafts. The chain wheels are axially offset and overlap each other. At least one support wheel on one shaft is associated with the chain wheel on the other shaft. An edge area of the part of the chain which does not engage a chain wheel is guided and supported on the shaft by the support wheel.

7 Claims, 5 Drawing Sheets

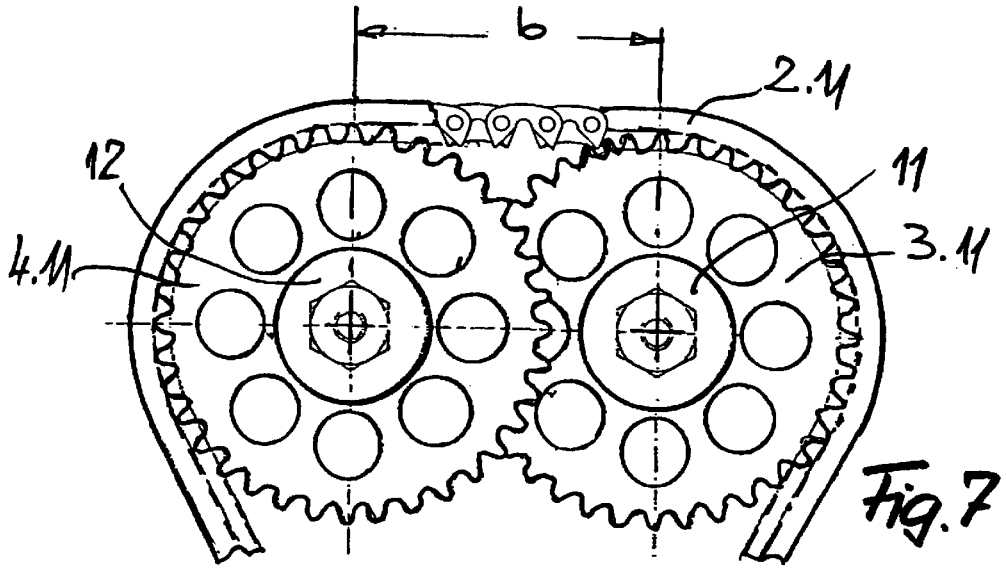
Fig. 7
Fig. 8
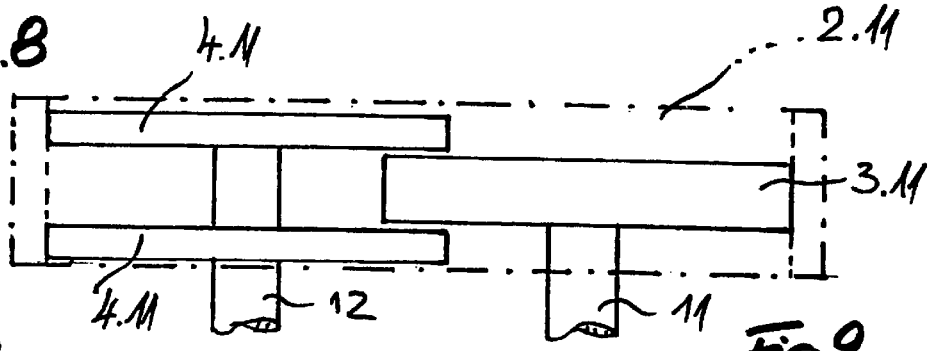
Fig. 9
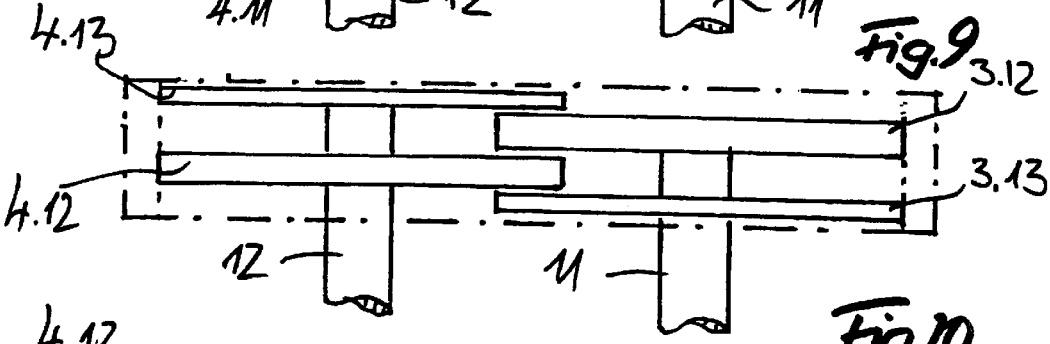
Fig 10
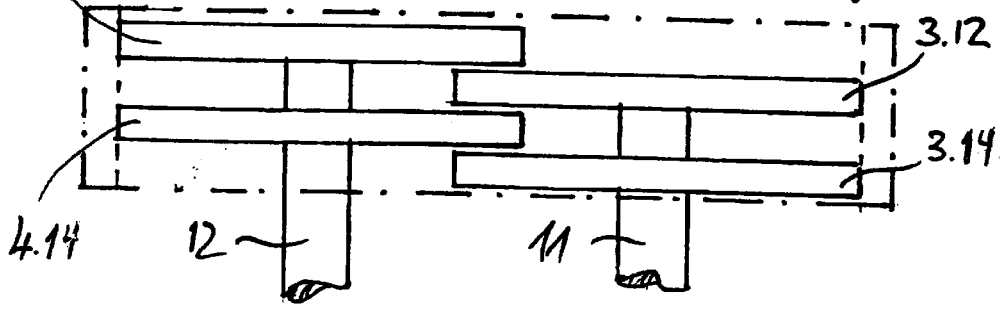

CHAIN DRIVE FOR DRIVING TWO PARALLEL SHAFTS LOCATED CLOSE TO EACH OTHER

BACKGROUND OF THE INVENTION

With drives having two parallel shafts operated via a drive roller chain and corresponding chain wheels, e.g. for driving two upper positioned camshafts of a piston-type internal combustion engine, the problem frequently arises that the two shafts must be positioned relatively far apart as a result of the outside diameter of the chain wheels, which results from the transferring torque or the operating conditions of the drive shaft chain. With a camshaft drive on a piston-type internal combustion engine, the camshaft position relative to the position of the cylinder valves therefore cannot always be selected optimally. The arrangement of a gearwheel drive between the two shafts is costly and the arrangement of a chain transfer drive does not lead to the desired close positioning, owing to the necessary gearwheel outside diameter.

BRIEF SUMMARY OF THE INVENTION

It is an object of the invention to solve the aforementioned problems with the aid of a chain drive.

According to the invention, this and other objects are solved with a chain drive for driving two parallel shafts located close to each other, in particular two upper positioned camshafts on a piston-type internal combustion engine. The drive is provided with a drive chain that is guided on the shafts by means of a drive and via chain wheels. At least one chain wheel is arranged on each shaft, wherein the chain wheels are axially offset relative to each other and are arranged overlapping. The chain wheel of one shaft is respectively associated with the support wheel on the other shaft, which supports and guides an edge region of the section of chain not engaged in a chain wheel on this shaft.

As a result of the offset and overlapping arrangement of the chain wheels on the two shafts, a narrower shaft spacing than specified for the chain wheel diameter can be realized. The two shafts are jointly driven via a chain, wherein the edge region of the chain section that is respectively not guided over a chain wheel is guided over a support wheel. The frictional losses correspond to that of a normal chain drive. The support wheel in this case can have a circular outside circumference. However, it is advantageous if the outer circumference of the support wheel has a polygonal shape, which essentially corresponds to the contour of the close-fitting chain region. With an embodiment having a multi-line drive chain (roller chain or bushing chain), the chain side bars rest on the support wheel. For an embodiment with a toothed chain, the edge of the toothed chain rests on the support wheel, so that the contour of the support wheel correspondingly can be designed as toothed wheel.

If a double-line or a multi-line drive chain is used, the chain wheels can be offset relative along their respective shaft relative to one another by approximately the distance between the chain sections.

If a toothed chain is used, the chain wheels and the at least one support wheel in an overlapping region define a total width corresponding to the width of the drive chain. The chain wheels and support wheels on each shaft can have a width equal to the width of the chain wheels and the support wheels on the other shaft.

In order to reduce the noise development, it is advantageous if a preferably locally arranged slider acts upon the chain strand that connects the two chain wheels. The slider causes a preferably slight deflection, thus reducing chain strand vibrations and a "beating" of the chain links when these are taken up by the chain wheel. The resulting slight increases in the frictional losses are countered by a reduction in the noise development. The level of the frictional losses also depends on the degree of tensioning of the chain strand by the slider.

The invention is not limited to drive chains, in particular the use of roller chains or bushing chains or toothed chains. In addition to a "drive chain" in the true sense of the word, the terms "drive chain" and "chain wheel" also cover a toothed belt and correspondingly a toothed belt pulley. The term "chain drive" within the meaning of this invention therefore also includes a toothed belt drive.

BRIEF DESCRIPTION OF THE DRAWINGS

The invention is explained with the aid of schematic drawings for an exemplary embodiment. Shown are in:

FIG. 7 A camshaft drive with toothed chain.

FIG. 8 A view from above according to FIG. 4, of an embodiment with toothed chain.

FIGS. 9 and 10 Modifications of the embodiment according to FIG. 8.

DETAILED DESCRIPTION OF THE INVENTION

Figure 1:
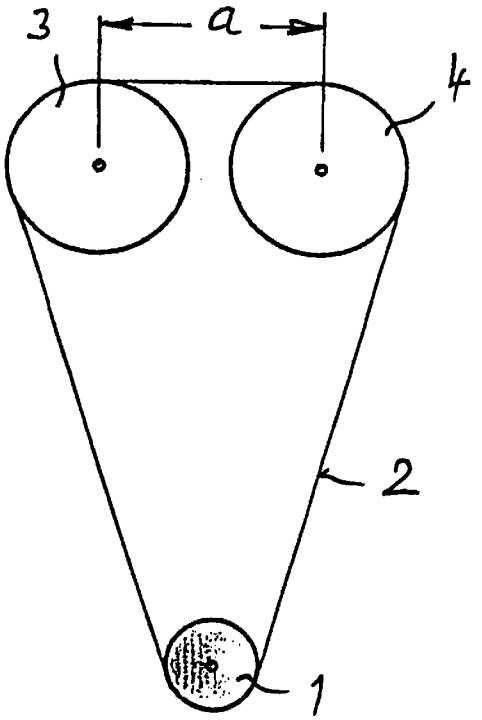
Fig. 1 PRIOR ART
FIG. 1 A traditional camshaft drive with a control chain.
Figure 2:
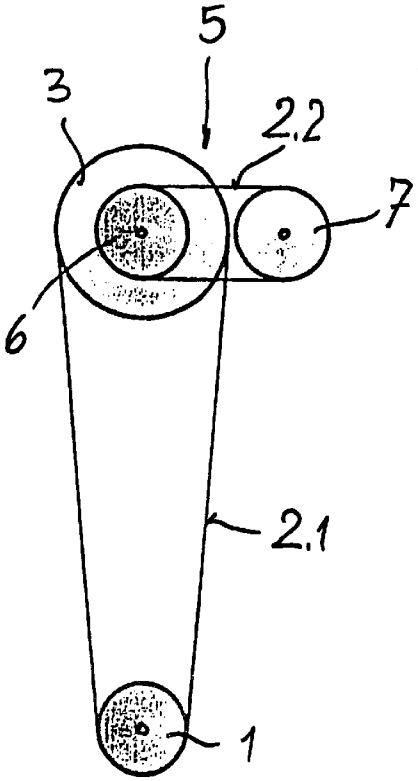
Fig. 2 PRIOR ART
FIG. 2 A camshaft drive with chain transfer drive.

With a traditional camshaft drive according to FIG. 1, the camshaft speed is tapped via a chain wheel 1 as drive and is transferred with the aid of a roller-type or a bushing-type drive chain 2 onto two chain wheels 3, 4. In accordance with the specified transmission ratio $n_{crankshaft}:n_{camshaft}$ of 2:1, these chain wheels have double the diameter of the drive chain wheel 1. The diameter for the two drive chain wheels 3 and 4, which are respectively connected to a camshaft not shown in further detail herein, determines the smallest possible distance a between the two camshafts.

To reduce the distance between the two camshafts for the embodiment shown in FIG. 1, the rotation of the chain wheel 1 is transmitted to a second camshaft via a first drive chain 2.1 and the chain wheel 3 that determines the transmission and is rotationally connected to one of the camshafts, as well as with the aid of a chain transfer gear 5. Thus, the chain wheel 3 is connected to a chain wheel 6, which is connected via another drive chain 2.2 to a chain wheel 7 on the other camshaft. However, this drive arrangement has the disadvantage that two separate control chains are needed, which must respectively be guided over separate chain tensioning devices. As a result, higher friction and a higher noise development occur.

Figure 3:
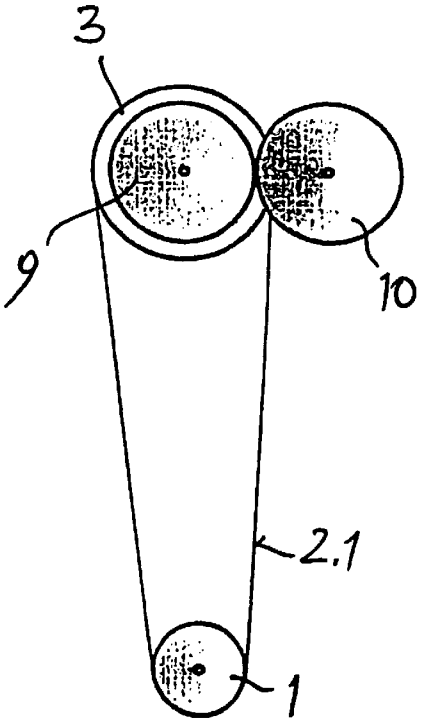
Fig. 3 PRIOR ART
FIG. 3 A camshaft drive with toothed wheel gearing.

The solution shown in FIG. 3 was selected as alternative. With this embodiment, a chain wheel 3 that is connected to a camshaft is driven via the chain wheel 1 and a first drive chain 2.1. A toothed wheel 9 is assigned to the chain wheel 3 and is connected to a corresponding toothed wheel 10 of the other camshaft, thus forming a toothed wheel gearing for a cross transfer drive. The distance between the two camshafts can be reduced with this solution, but this results in higher production and assembly costs.

Figure 4:
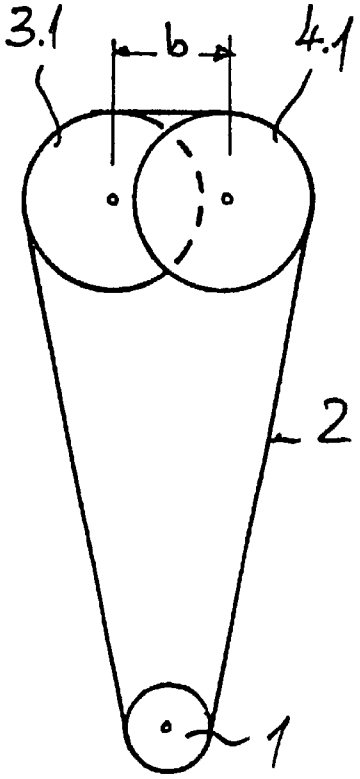
FIG. 4 A camshaft drive according to the invention with roller chain.

The invention starts with the drive according to FIG. 1. As can be seen in FIG. 4, the drive in this case is also tapped at the chain wheel 1 that is connected to the crankshaft and is transferred via a central drive chain 2 to a first chain-wheel arrangement 3.1 and a second chain-wheel arrangement 4.1. With this system, only one drive chain is provided, which is guided over both chain wheel arrangements 3.1 and 4.1.

Figure 5:
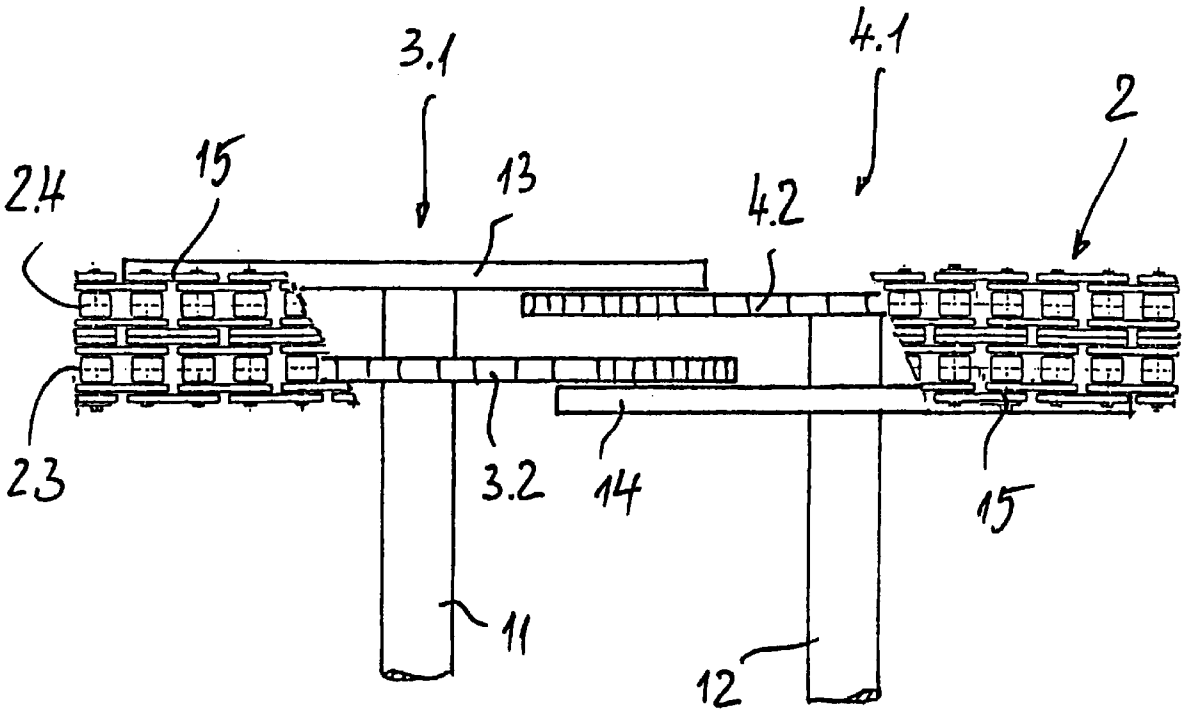
FIG. 5 A view from above of the drive according to FIG. 4.

As shown in the frontal view in FIG. 4 and in particular in the view from the top according to FIG. 5, the two chain-wheel drive arrangements 3.1 and 4.1 are arranged such that they overlap. Thus, both camshafts can be arranged at a shorter distance b relative to each other.

The view from above in FIG. 5 shows that this is achieved by providing two chain wheel arrangements respectively with a chain wheel 3.2 and a chain wheel 4.2, which are respectively connected securely to the associated shafts 11 and 12. FIG. 5 furthermore shows that the two chain wheels 3.2 and 4.2 are arranged overlapping, as previously mentioned, and thus also axially offset. The drive chain 2 is formed with a double-line roller and bushing chain. The distance between the two chain lines 2.3 and 2.4, relative to each other, also determines the distance between the chain wheels 3.2 and 4.2.

A support wheel 13 and 14 is assigned to each of the two chain wheels 3.2 and 4.2 of the chain arrangements 3.1 and 4.1. The control wheels 13 and 14 in turn are axially offset and arranged relative to each other in such a way that they respectively guide the outer side bars 15 of the chain line, which for the respective chain wheel arrangement 3.1 or 4.1 are not engaged in a chain wheel. The two support wheels 13 and 14 have a polygonal circumferential shape and are advantageously formed such that they correspond to the contour defined by the contacting outer side bars.

The associated drive chain wheel 1 is designed as double chain wheel, so that the drive chain wheel 1 drives the two chain lines 2.3 and 2.4. Each of the two chain lines accordingly drives one chain wheel, meaning the chain line 2.3 drives the chain wheel 3.2 and the chain line 2.4 drives the chain wheel 4.2. The polygonal circumferential shape of the two support wheels 13 and 14 in connection with the corresponding contour of the close-fitting outer side bars 15 respectively also contributes slightly to the transfer of the rotary moment to the associated shaft 11 or 12 because the drive chain 2 is tightened via a chain tensioning device.

Figure 6:
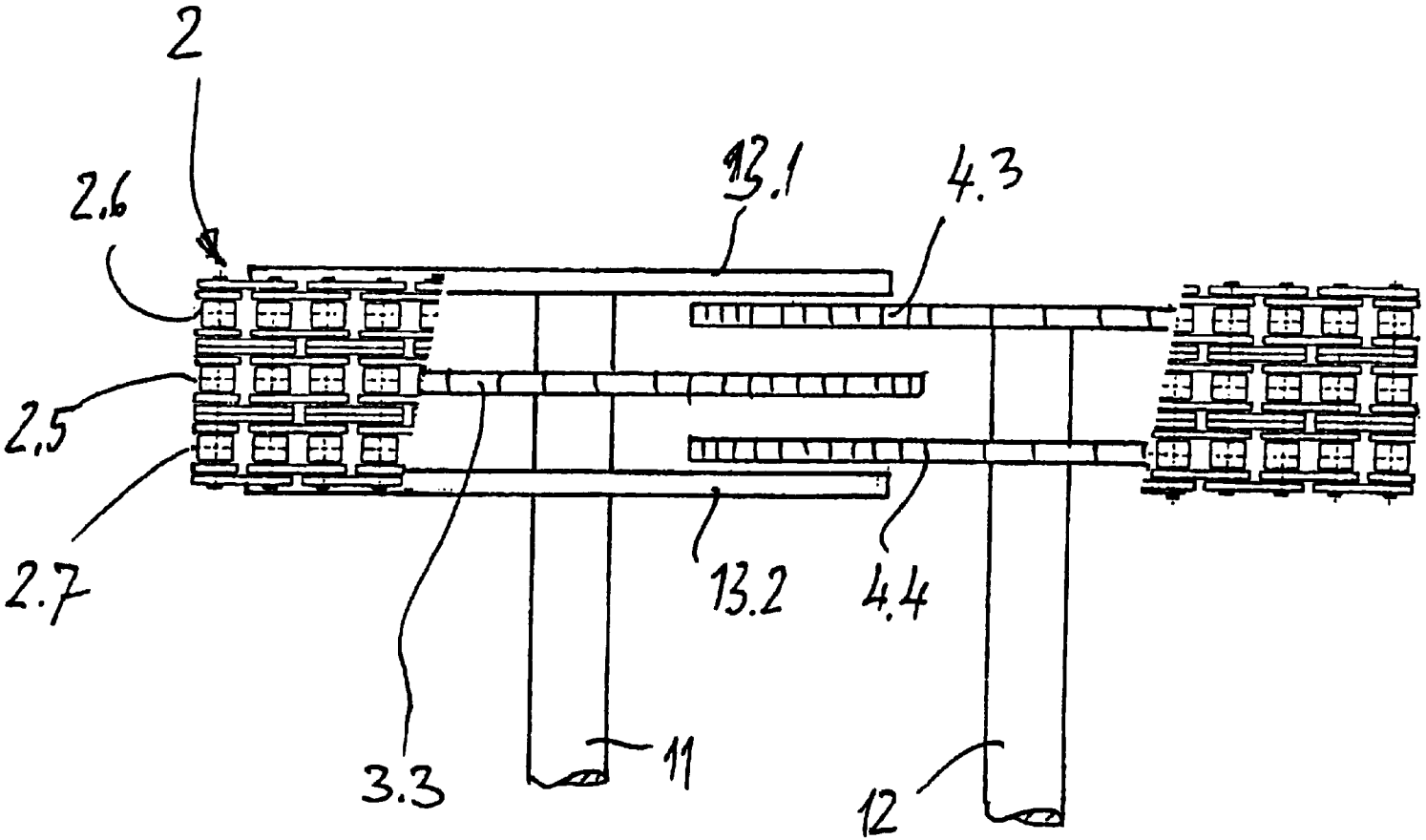
FIG. 6 A view from above according to FIG. 5, with a three-line control chain.

From FIG. 5, it is easy to infer that this principle can also be realized with a three-line drive chain. FIG. 6 shows that when using a three-line drive chain, only one chain wheel 3.3 is arranged on one of the shafts, for example the shaft 11, to which a corresponding support wheel 13.1 and 13.2 is assigned on each side. The center chain line 2.5 is guided over the chain wheel 3.3.

Two chain wheels 4.3 and 4.4 are thus assigned to the other shaft, for example the shaft 12. The axial distance between these wheels is measured such that the two outer chain lines 2.6 and 2.7 of the drive chain can be guided over the chain wheels 4.3 and 4.4. In that case, it is not necessary to arrange a support wheel between these two parallel chain wheels 4.3 and 4.4.

With this type of arrangement, the two chain wheels 4.3 and 4.4 on the one shaft 12 are coordinated with two support wheels 13.1 and 13.2 on the other shaft 11, which respectively guide and support the outer side bars of the chain lines 2.6 and 2.7 that do not engage in the center chain wheel 3.2 on this shaft 11. While the two chain lines for the embodiment according to FIG. 5 with a two-line drive chain are subject to a specific tilting moment, the last described embodiment with a three-line drive chain is free of moments.

The invention is not limited to the above-described uses for drive chains. In particular, the arrangement according to FIG. 6 is also suitable for use with toothed belts. In that case, it is advantageous if the toothed belts are provided with reinforcing elements that are arranged transverse to the movement direction, to prevent or reduce a bending through in the region between the toothed belt pulleys that correspond to the two chain wheels 4.3 and 4.4.

FIG. 7 shows on an enlarged scale a frontal view of a camshaft drive that corresponds to the embodiment according to FIG. 4. The drive is shown with a toothed belt 2.11 as a drive chain that is guided over two chain wheels 3.11 and 4.11, which are connected so as to rotate along with the shafts 11 and 12.

The two chain wheels 3.11 and 4.11 overlap, as shown schematically in FIG. 4, so that the two shafts 11 and 12 to be driven can be arranged relative to each other at the corresponding short distance b.

Combination arrangements of toothed wheel and support wheel are possible for a reliable and, if possible, non-tilting support of the toothed belt 2.11. However, the advantage of using a toothed belt 2.11 as a drive chain is that it is formed in the manner of a flyer chain from a plurality of offset and overlapping side bars, which are connected with bolts. On one running side, these side bars are shaped like teeth, so that the chain on the whole forms a continuous toothing. The side bars are positioned in sliding and roller joints on the bolts. Owing to the close arrangement of the side bars next to each other, the toothed chain is relatively rigid, except for the deflection direction. Accordingly, a mostly free assignment of the chain wheels and support wheels relative to each other is possible. The advantage is that the support wheels can be designed as chain wheels with respect to their outer circumferential contour, as well as the diameter.

FIG. 8 shows an arrangement where a wide chain wheel 3.11 is overlapped by two chain wheels 4.11, which are respectively half as wide and function as the chain wheel and the support wheel. The total width of the small chain wheels 4.11 that extend past the chain wheel 3.11 corresponds to the width of the installed drive chain 2.11, which is only indicated herein. The supporting width of the chain wheel 3.11 and the two chain wheels 4.11 together must always correspond to the required width for transferring the desired rotary moment.

FIG. 9 shows a modified arrangement where a wide chain wheel 3.12 and a narrow chain wheel 3.13 are respectively assigned to the shaft 11 as well as the shaft 12. A wide chain wheel 4.12 and a narrow chain wheel 4.13 are assigned to the shaft 12.1. The chain wheels overlap as shown, so that the total width in the overlapping region again corresponds to the width of the toothed chain. On the other hand, the chain wheels for both shafts have the same supporting width, so that the desired rotary moment can be transferred.

FIG. 10 shows a modified version of the arrangement according to 9, for which two equally wide chain wheels 3.12, 3.14 or 4.12 and 4.14 are arranged respectively on each shaft.

Another advantage of the toothed chains is that with each side bar packet, respectively two side bars are designed without toothed profile, which side bars are arranged at a distance to each other, so that in the looping region, these side bars guide the drive chain respectively on both sides of the teeth in axial direction. With the arrangement according to FIG. 8, the lateral distance between the two guide brackets would correspond to the width of the chain wheel 3.11, so that in the looping region, the toothing of chain wheel 3.11 would be covered on both sides. The drive chain would thus be guided in axial direction on this chain wheel 3.11. At the two parallel chain wheels 4.11, the drive chain would respectively be guided axially by the two opposite arranged sides of the toothing for this chain wheel, so that the drive chain is kept in its line at this chain wheel as well.

With the arrangements according to FIGS. 9 and 10, the chain must be designed accordingly with respect to the guide bracket arrangement.

Figure 11:
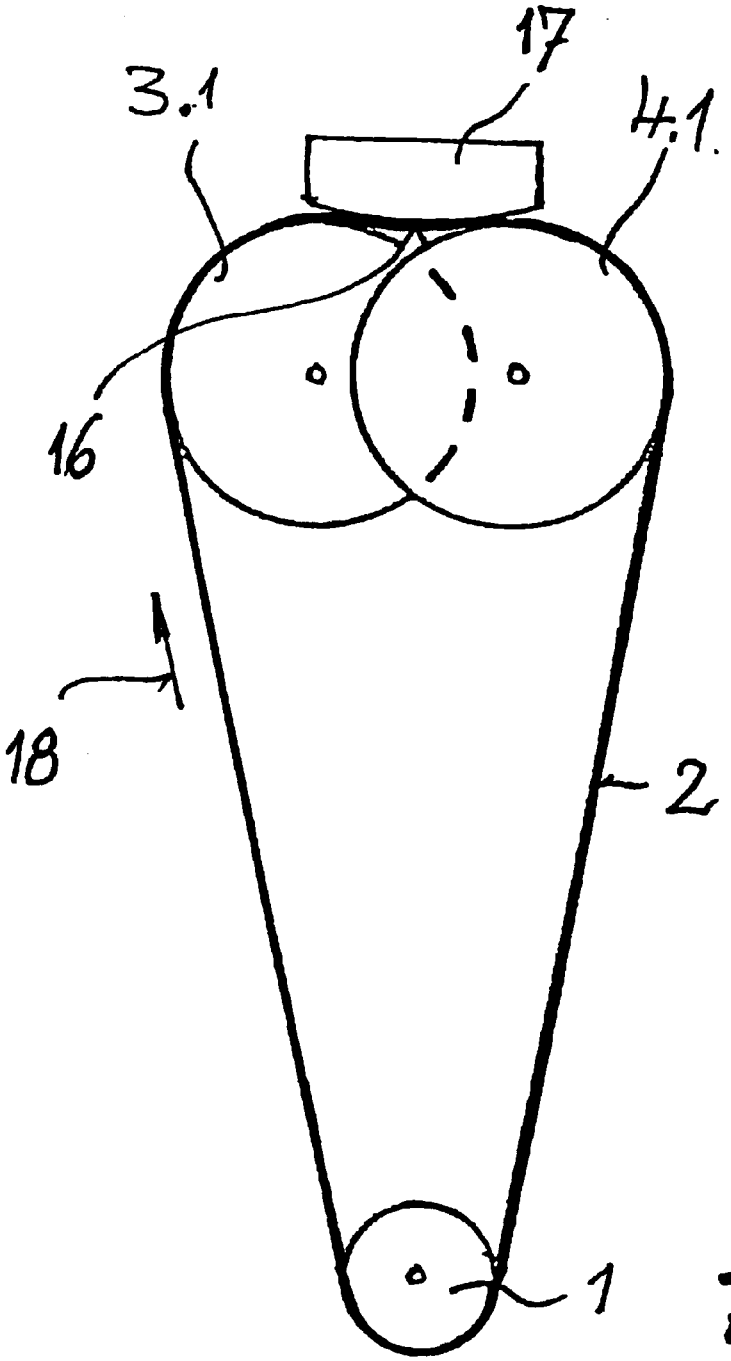
FIG. 11 An embodiment according to FIG. 4 with deflecting slider.

FIG. 11 shows a modification of the basic arrangement shown in FIG. 4. For this, a slider 17 is provided to reduce the noise development, which slider fits flush against the chain strand 16 that connects the two chain wheels 3.1 and 4.1. Owing to the slider 17, which can be positioned rigidly or even springy, the chain strand 16 is deflected slightly, so that the conditions for feeding the chain onto the chain wheel 4.1 are improved for a run in the direction of arrow 18. Vibrations in the chain strand in the articulation plane are simultaneously prevented. As a result, the frictional losses increase only slightly because the normal force that also determines the amount of the frictional force is very low, even with a high traction force of the chain. This type of arrangement can be used with all drive chains.

Depending on the spatial conditions provided and whether roller chains or bushing chains are used, the slider 17 can also be arranged between the chain wheels and can deflect the chain strand 16 in the opposite direction.

What is claimed is:

1. A chain drive for driving first and second parallel shafts, comprising:

a drive;

at least one chain wheel arranged on each shaft, the chain wheels being axially offset relative to each other and being arranged overlapping one another;

a drive chain engaging each at least one chain wheel, the drive chain having at least two sections with each section engaging one of the chain wheels; and at least one support wheel arranged on at least the first shaft for guiding and supporting an edge region of the chain section that is not engaged with the at least one chain wheel on the first shaft.

2. A chain drive according to claim 1, wherein the drive chain is an at least two-line drive chain, the chain wheels being offset along their respective shaft relative to one another by approximately the distance between the chain sections.

3. A chain drive according to claim 1, wherein the drive chain is a toothed chain.

4. A chain drive according to claim 3, wherein the chain wheels and the at least one support wheel in an overlapping region define a total width, the drive chain having a chain width corresponding to the total width.

5. A chain drive according to claim 3, wherein the at least one chain wheel and at least one support wheel on each of the shafts respectively define first and second widths, the first width being approximately equal to the second width.

6. A chain drive according to claim 1, wherein the drive chain includes a chain strand extending between the at least one chain wheel on the first shaft and the at least one chain wheel on the second shaft, the chain drive further comprising a deflecting slide block arranged against at least a portion of the chain strand.

7. The chain drive according to claim 1, wherein the at least one chain wheel on the first shaft is separated from the at least one support wheel on the first shaft.

* * * * *